US009822598B2

(12) United States Patent
Miller et al.

(10) Patent No.: US 9,822,598 B2
(45) Date of Patent: Nov. 21, 2017

(54) DOWNHOLE IMPACT GENERATION TOOL AND METHODS OF USE

(71) Applicant: Halliburton Energy Services, Inc., Houston, TX (US)

(72) Inventors: Todd Blaine Miller, Carrollton, TX (US); Jack Gammill Clemens, Fairview, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 525 days.

(21) Appl. No.: 14/344,394

(22) PCT Filed: Apr. 11, 2013

(86) PCT No.: PCT/US2013/036172
§ 371 (c)(1),
(2) Date: Mar. 12, 2014

(87) PCT Pub. No.: WO2014/168623
PCT Pub. Date: Oct. 16, 2014

(65) Prior Publication Data

US 2016/0102514 A1 Apr. 14, 2016

(51) Int. Cl.
*E21B 31/107* (2006.01)
*E21B 31/113* (2006.01)
*E21B 47/12* (2012.01)

(52) U.S. Cl.
CPC ..... *E21B 31/107* (2013.01); *E21B 31/113* (2013.01); *E21B 47/12* (2013.01)

(58) Field of Classification Search
None
See application file for complete search history.

(56) References Cited

U.S. PATENT DOCUMENTS 3,946,819 A * 3/1976 Hipp ..... E21B 4/14 173/78
6,502,638 B1 1/2003 Stoesz
(Continued)

FOREIGN PATENT DOCUMENTS

EP 0477452 A2 4/1992
WO 2014168623 A1 10/2014

OTHER PUBLICATIONS

International Search Report and Written Opinion for PCT/US2013/036172 dated Jan. 7, 2014.

*Primary Examiner* — Caroline Butcher
(74) *Attorney, Agent, or Firm* — McDermott Will & Emery LLP

(57) ABSTRACT

An impact generator includes a housing having an uphole end and a downhole end and defining a chamber therein between the uphole and downhole ends. A mandrel is movably arranged at least partially within the chamber between an engaged configuration and a disengaged configuration, and a top sub is coupled to the housing at the uphole end and has an upper core extension arranged at least partially therein. The upper core extension is configured to move between a fixed position, where the mandrel is maintained in the engaged configuration, and an unfixed position, where the mandrel is able to move to the disengaged configuration. An impact tool is coupled to a distal end of the mandrel to deliver an impact force to a downhole obstruction when the mandrel is moved to the disengaged configuration.

19 Claims, 5 Drawing Sheets

(56) References Cited

U.S. PATENT DOCUMENTS

| | | | | |
|---|---|---|---|---|
| 7,293,614 | B2 | 11/2007 | Rose | |
| 7,367,397 | B2 | 5/2008 | Clemens et al. | |
| 8,256,509 | B2 | 9/2012 | Evans | |
| 2005/0056427 | A1* | 3/2005 | Clemens | E21B 41/00 166/301 |
| 2006/0054322 | A1 | 3/2006 | Rose | |
| 2007/0151732 | A1* | 7/2007 | Clemens | E21B 31/107 166/301 |
| 2007/0277980 | A1* | 12/2007 | Gordon | E21B 43/112 166/298 |
| 2012/0298365 | A1 | 11/2012 | Evans | |

* cited by examiner

DOWNHOLE IMPACT GENERATION TOOL AND METHODS OF USE

This application is a National Stage entry of and claims priority to International Application No. PCT/US2013/036172, filed on Apr. 11, 2013.

BACKGROUND

The present disclosure relates to downhole tools and, in particular, to an impact generation tool used to deliver a large downhole impact force.

After drilling a well that intersects a subterranean hydrocarbon bearing reservoir, a variety of well tools are often positioned in the wellbore during completion, stimulation, production, or remedial activities. For example, temporary packers are often set in the wellbore during the completion and production operating phases of the well. In addition, various operating tools including flow controllers (e.g., plugs, chokes, valves, and the like) and safety devices (e.g., safety valves, etc.) are often retrievably positioned within the wellbore.

In some cases, a well tool installed within the wellbore may become stuck in the wellbore and may require an impact or jarring force to be applied thereto in order to dislodge the tool from its stuck position. In other cases, the impact or jarring force may be used to break a well tool, such as a ceramic or steel flapper valve, such that fluid communication therethrough is facilitated. In yet other cases, junk or debris may accumulate in the wellbore and the impact or jarring force may be used to dislodge such debris from the wellbore. Accordingly, it may prove advantageous to have a downhole tool configured to deliver a high impact downward force to a well tool or other downhole obstruction. It may also prove advantageous to have a downhole tool configured to deliver such a high impact downward force in deep, deviated, inclined, or horizontal wellbores where traditional gravity-powered impact tools are otherwise rendered ineffective.

SUMMARY OF THE DISCLOSURE

The present disclosure relates to downhole tools and, in particular, to an impact generation tool used to deliver a large downhole impact force.

In some embodiments, a downhole impact generator may be disclosed and may include a housing having an uphole end and a downhole end and defining a chamber therein between the uphole and downhole ends, a mandrel movably arranged at least partially within the chamber between an engaged configuration and a disengaged configuration, a top sub coupled to the housing at the uphole end and having an upper core extension arranged at least partially therein, the upper core extension being configured to move between a fixed position, where the mandrel is maintained in the engaged configuration, and an unfixed position, where the mandrel is able to move to the disengaged configuration, and an impact tool coupled to a distal end of the mandrel and being configured to deliver an impact force to a downhole obstruction when the mandrel is moved to the disengaged configuration.

In some embodiments, a method of delivering an impact force to a downhole obstruction within a wellbore may be disclosed. The method may include conveying an impact generator to the downhole obstruction, the impact generator comprising a housing, a mandrel movably arranged at least partially within a chamber defined in the housing, and a top sub coupled to an uphole end of the housing and having an upper core extension arranged at least partially within the top sub, moving the upper core extension from a fixed position, where the mandrel is maintained in an engaged configuration within the housing, to an unfixed position, where the mandrel is able to move to a disengaged configuration, moving the mandrel to the disengaged configuration with a biasing device axially arranged within the chamber, and impacting the downhole obstruction with an impact tool coupled to a distal end of the mandrel when the mandrel is moved to the disengaged configuration.

In some embodiments, another downhole impact generator may be disclosed and may include a housing having an uphole end and a downhole end and a chamber defined therein between a lip defined within the housing and an anvil arranged at or near the downhole end, a mandrel movably arranged at least partially within the chamber and defining a shoulder that extends radially about the mandrel, a first biasing device arranged within the chamber between the lip and the shoulder of the mandrel, and an actuation device arranged within the housing and operatively coupled to the mandrel and configured to move the mandrel such that the first biasing device is compressed between the lip and the shoulder, the actuation device being further configured to release the mandrel such that the first biasing device is able expand and move the mandrel in a downhole direction to provide an impact force.

In some embodiments, another a method of delivering an impact force to a downhole obstruction within a wellbore may be disclosed. The method may include conveying an impact generator to the downhole obstruction, the impact generator comprising a housing, a mandrel movably arranged at least partially within a chamber defined in the housing between a lip and an anvil both defined in the housing, and a first biasing device axially arranged within the chamber between the lip and a shoulder defined on the mandrel, activating an actuation device arranged within the housing, the actuation device being operatively coupled to the mandrel, moving the mandrel with the actuation device such that the first biasing device is compressed between the lip and the shoulder, and releasing the mandrel such that the first biasing device is able to expand and move the mandrel in a downhole direction to provide an impact force.

The features of the present disclosure will be readily apparent to those skilled in the art upon a reading of the description of the embodiments that follows.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present disclosure relates to downhole tools and, in particular, to an impact generation tool used to deliver a large downhole impact force.

The embodiments described herein provide a means of delivering a high downward impact force to a downhole obstruction, such as a well tool or debris that may be lodged or otherwise stuck downhole. In particular, disclosed is a downhole impact generator that includes a spring-loaded mandrel coupled to an impact tool that may be thrust downward once properly activated. In some embodiments, the downward impact force may interact with and otherwise activate a well tool, such as by shearing one or more pins or by shifting a sliding sleeve. In other embodiments, the downward impact force may be configured to simply deliver a high impact blow to dislodge debris lodged in a wellbore or to break a valve set within the wellbore. A loading tool may be subsequently attached to the impact generator to re-load the impact generator in preparation for the delivery of another high impact blow.

Figure 1:
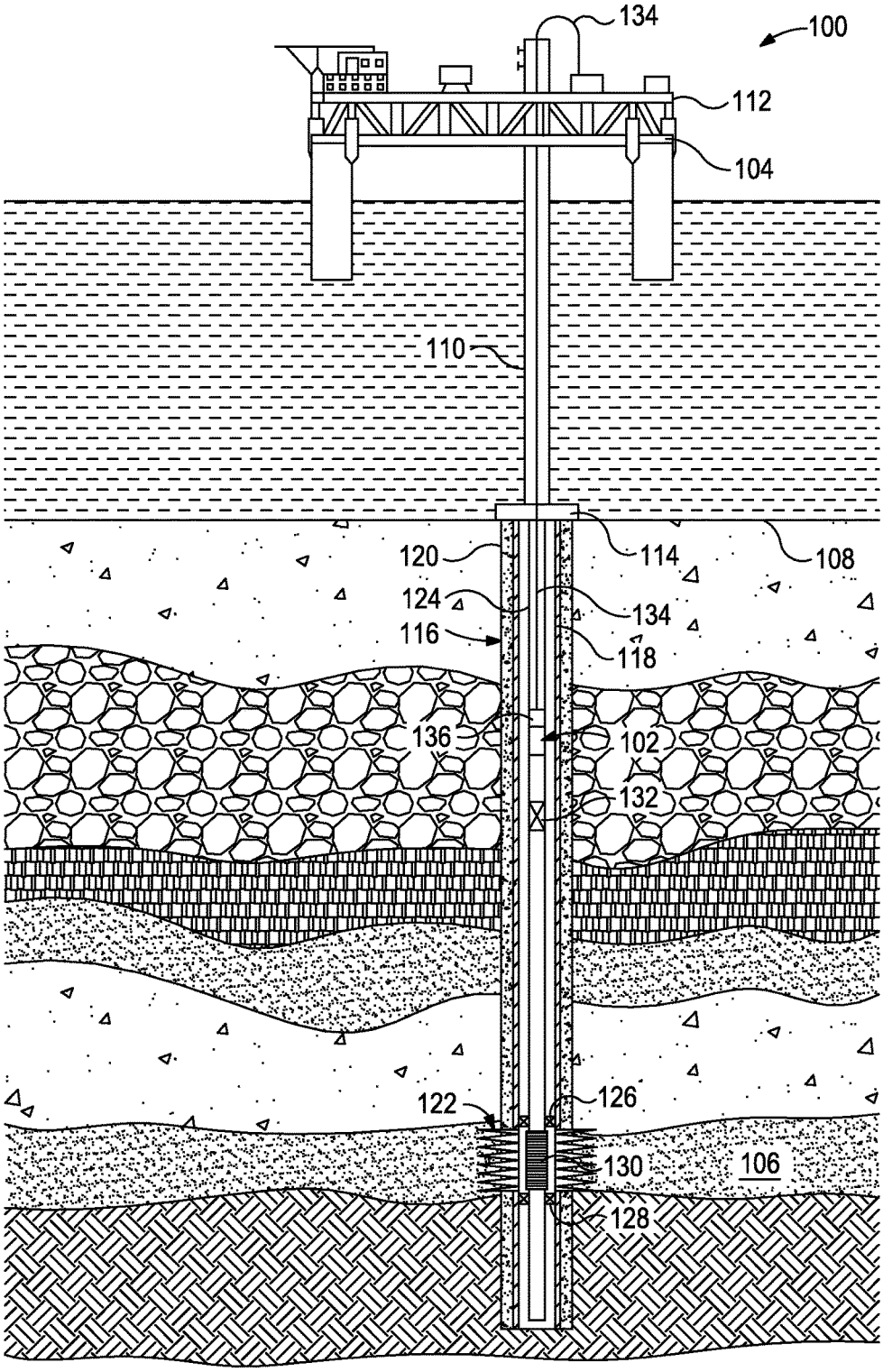
FIG. 1 is an offshore oil and gas platform that may employ an exemplary downhole impact generator, according to one or more embodiments.

Referring to FIG. 1, illustrated is an offshore oil and gas platform 100 that may employ an exemplary downhole impact generator 102, according to one or more embodiments. Even though FIG. 1 depicts an offshore oil and gas platform 100, it will be appreciated by those skilled in the art that the various embodiments discussed herein are equally well suited for use in or on other types of oil and gas rigs, such as land-based oil and gas rigs or rigs located at any other geographical site.

As illustrated, the platform 100 may be a semi-submersible platform 104 centered over a submerged oil and gas formation 106 located below the sea floor 108. A subsea conduit 110 or riser extends from the deck 112 of the platform 104 to a wellhead installation 114. As depicted, a wellbore 116 extends from the sea floor 108 and has been drilled through the various earth strata, including the formation 106. A casing string 118 is at least partially cemented within the main wellbore 116 with cement 120. The casing string 118 may have multiple perforations 122 defined therein such that the wellbore 116 may fluidly communicate with the surrounding formation 106. The term "casing" is used herein to designate a tubular string used to line the wellbore 116. The casing may actually be of the type known to those skilled in the art as "liner" and may be segmented or continuous, such as coiled tubing.

A tubing string 124, such as production tubing, extends at least from the wellhead installation 114 to the formation 106 to provide a conduit for production fluids to travel to the surface. A pair of packers 126, 128 provide a fluid seal between the tubing string 124 and the casing string 118 and direct the flow of production fluids from the formation 106 through a sand control screen 130. Disposed within the tubing string 124 may be a downhole obstruction 132. In some embodiments, the downhole obstruction 132 may be a well tool such as, but not limited to, a flow control device, a safety device, a valve, one or more types of shear-out subs, or the like. In other embodiments, however, the downhole obstruction 132 may be any tubular obstruction, such as wellbore debris or junk that may be lodged or otherwise stuck in the tubing string 124.

The downhole impact generator 102 may be run into the wellbore 116 on a conveyance 134, such as a wireline, a slickline, an electric line, a jointed tubing, a coiled tubing, or the like. In other embodiments, however, the downhole impact generator 102 may be run downhole using an autonomous conveyance such as a downhole robot, as known by those skilled in the art. The impact generator 102 may include an anchor 136 configured to be actuated and thereby grip the interior of the tubing string 124 in order to secure the impact generator 102 therein and otherwise minimize its axial movement during operation.

In exemplary operation, the downhole impact generator 102 may be conveyed downhole to a target location within the wellbore 116 where the downhole obstruction 132 is located. Once properly secured within the wellbore 116 at the target location using the anchor 136, the impact generator 102 may be actuated and thereby deliver a high impact force to the downhole obstruction 132. In some embodiments, the impact force may be configured to break the downhole obstruction 132 such that communication therethrough within the wellbore 116 is possible. In other embodiments, the high impact force may be configured to dislodge the downhole obstruction 132 such that it may be removed or otherwise bypassed. In yet other embodiments, where the downhole obstruction 132 is a well tool of some sort, the high impact force from the impact generator 102 may be used to activate the well tool such as by breaking one or more shearable devices (e.g., shear pins, shear screws, shear rings, etc.), shifting a sliding sleeve, or the like. For example, in embodiments where the downhole obstruction 132 is a shear-out sub, or the like, the impact generator 102 may be configured to impact and shear various shearable devices (e.g., shear pins, shear ring, etc.) arranged within the shear-out sub.

The downhole impact generator 102 may be capable of generating the required impact force necessary to act on the downhole obstruction 132 in any type of wellbore 116. For example, while FIG. 1 shows the downhole obstruction 132 as being lodged or otherwise arranged within the tubing string 124, those skilled in the art will readily appreciate that in some embodiments the tubing string 124 may be omitted and the downhole impact generator 102 may equally be used to act on a downhole obstruction 132 lodged or otherwise arranged in an open or cased wellbore 116, without departing from the scope of the disclosure. Moreover, even though FIG. 1 depicts a substantially vertical well, it will be appreciated by those skilled in the art that the downhole impact generator 102 is equally well-suited for use in wellbores having other directional configurations including horizontal wellbores, deviated wellbores, slanted wellbores, diagonal wellbores, combinations thereof, and the like.

Use of directional terms such as above, below, upper, lower, upward, downward, uphole, downhole, and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well. As used herein, the term "proximal" refers to that portion of the component being referred to that is closest to the wellhead, and the term "distal" refers to the portion of the component that is furthest from the wellhead.

Figure 2A:
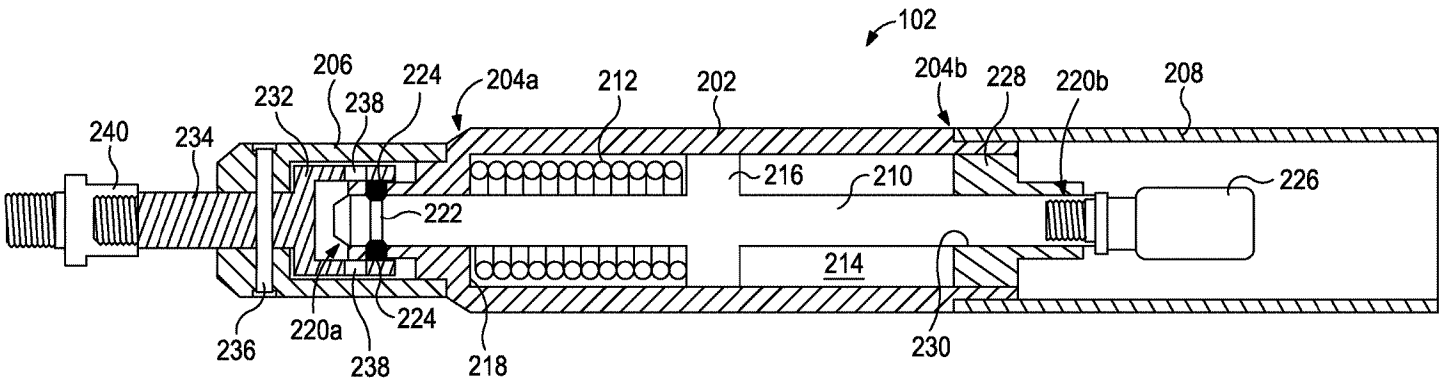
FIG. 2A is a partial cross-sectional view of an exemplary downhole impact generator in a loaded configuration, according to one or more embodiments.
Figure 2B:
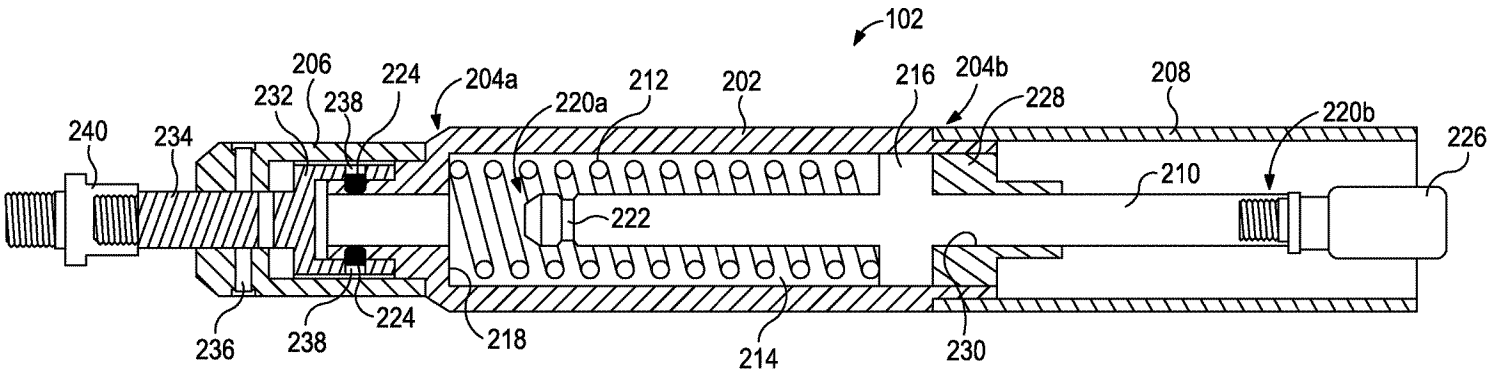
FIG. 2B is a partial cross-sectional view of the exemplary downhole impact generator of FIG. 2A in a released configuration, according to one or more embodiments.

Referring now to FIGS. 2A and 2B, with continued reference to FIG. 1, illustrated are partial cross-sectional views of the exemplary downhole impact generator 102, according to one or more embodiments. In particular, FIG. 2A depicts the impact generator 102 in a loaded configuration, and FIG. 2B depicts the impact generator 102 in a released configuration. As will be discussed herein, the impact generator 102 may be actuated or otherwise activated in order to move from its loaded configuration to its released configuration.

As illustrated, the impact generator 102 may include a housing 202 having an uphole end 204*a* and a downhole end 204*b*. A top sub 206 may be coupled to the housing 202 at its uphole end 204*a* and a housing sleeve 208 may be coupled at the downhole end 204*b*. In some embodiments, one or both of the top sub 206 and the housing sleeve 208 may be threaded to the uphole and downhole ends 204*a,b*, respectively. In other embodiments, however, one or both of the top sub 206 and the housing sleeve 208 may be mechanically fastened or attached to the uphole and downhole ends 204*a,b*, respectively.

The impact generator 102 may further include a mandrel 210 movably arranged within a chamber 214 defined in the housing 202 between an engaged configuration and a disengaged configuration. FIG. 2A depicts the mandrel 210 in the engaged configuration, and FIG. 2B depicts the mandrel 210 in the disengaged configuration. The mandrel 210 may define a shoulder 216 that extends radially about the mandrel 210 at an intermediate location along its axial length. The impact generator 102 may also include at least one biasing device 212 also arranged within the chamber 214 and otherwise axially arranged between the shoulder 216 and the housing 202. In particular, the distal end of the biasing device 212 may be configured to engage the shoulder 216, while its proximal end may be configured to engage an internal axial end 218 of the housing 202. In some embodiments, the biasing device 212 may be a compression spring, as generally illustrated. In other embodiments, however, the biasing device 212 may be a series of Belleville washers, or the like. As shown in FIG. 2A, the biasing device 212 is in a compressed configuration. FIG. 2B, on the other hand, depicts the biasing device 212 in an expanded configuration.

The mandrel 210 has a first or proximal end 220*a* and a second or distal end 220*b*. At its proximal end 220*a*, the mandrel 210 may define an annular groove 222 configured to receive one or more dogs or lugs 224 therein. The lugs 224 may be configured to be seated within the groove 222 in order to secure the mandrel 210 in the engaged configuration within the housing 202 and otherwise maintain the biasing device 212 in its compressed configuration. Once the lugs 224 are removed from engagement with the groove 222, as will be described below, the biasing device 212 may be able to axially expand and force the mandrel 210 downward within the housing 202 and to its disengaged configuration.

An impact tool 226 may be coupled or otherwise attached to the distal end 220*b* of the mandrel 210. In some embodiments, as illustrated, the impact tool 226 may be threaded to the distal end 220*b* of the mandrel 210. In other embodiments, however, the impact tool 226 may be fastened or attached to the distal end 220*b* of the mandrel 210 using one or more mechanical fasteners such as, but not limited to, bolts, screws, pins, clamps, combinations thereof, and the like. The impact tool 226 may be any type of tool or device configured to transfer axial or linear motion of the mandrel 210 into an impact force that may be delivered to, for example, a downhole obstruction 132 as described above with reference to FIG. 1. In some embodiments, for example, the impact tool 226 may be a punch tool, a center punch, a chisel, or the like. In other embodiments, however, the impact tool 226 may be a blind box or the like.

An anvil 228 may be arranged or otherwise secured within the housing 202 at or near its downhole end 204*b* and may partially define an axial end of the chamber 214. The anvil 228 may either be threaded or mechanically fastened within the housing 202 such that it is secured against axial movement with respect thereto. In some embodiments, the anvil 228 may form an integral part of the housing 202. The anvil 228 may define a central channel 230 configured to receive and slidably engage a portion of the mandrel 210 during operation.

The impact generator 102 may further include an upper core extension 232 at least partially arranged within the top sub 206 and having a stem 234 extending axially therefrom and out of the upper end of the top sub 206. The upper core extension 232 may be moveable from a fixed position, as depicted in FIG. 2A, to an unfixed position, as depicted in FIG. 2B. In at least one embodiment, the upper core extension 232 may be secured in the fixed position using one or more shearable devices 236, such as a shear pin, a shear screw, or the like. Once the shearable device 236 is "sheared" or otherwise fails, the upper core extension 232 may be free to move to the unfixed position.

In at least one embodiment, the shearable device 236 may be omitted and the upper core extension 232 may instead be moved to the unfixed position using one or more downhole devices (not shown) configured to axially translate the upper core extension within the top sub 206. For example, a downhole device such as, but not limited to, a mechanical device, an electro-mechanical device, or a hydro-mechanical device may be operatively coupled to the upper core extension 232 and configured to move the upper core extension 232 between its fixed and unfixed positions.

One or more slots 238 (two shown) may be defined in the upper core extension 232 and configured to receive or otherwise seat the lugs 224 when the upper core extension 232 moves to the unfixed position. When in the fixed position, however, the upper core extension 232 may be configured to radially bias the lugs 224 such that they are forced into securing engagement with the annular groove 222, and thereby securing the mandrel 210 in its engaged configuration.

A shear release adapter 240 may be coupled or otherwise attached to the proximal end of the stem 234. In some embodiments, as illustrated, the shear release adapter 240 may be threaded to the proximal end of the stem 234. In other embodiments, however, the shear release adapter 240 may be fastened or attached to the proximal end of the stem 234 using one or more mechanical fasteners such as, but not limited to, bolts, screws, pins, clamps, combinations thereof, and the like. With reference to FIG. 1, the shear release adapter 240 may be configured to attach the downhole impact generator 102 to the remaining subs or tools conveyed into the wellbore 116 via the conveyance 134.

In some embodiments, the shear release adapter 240 may be coupled to a jarring device (not shown) configured to convey an axial impact force to the upper core extension 232 sufficient to shear or break the shearable device 236. In at least one embodiment, the jarring device may be a "spang"

jar or mechanical jar, as known by those skilled in the art. In other embodiments, however, the impact device may be any mechanism or device configured to provide the necessary force required to shear the shearable device 236 and may include any mechanical (e.g., a slide hammer device), electromechanical, or hydro-mechanical downhole tool or device.

In exemplary operation of the downhole impact generator 102, an axial impact force may be sustained or otherwise received by the shear release adapter 240, as generally described above. Upon receiving such an axial impact force, the shearable device 236 may be sheared or otherwise broken, thereby freeing the upper core extension 232 and otherwise allowing it to move from its fixed position into its unfixed position. In other embodiments, however, as also described above, the shearable device 236 may be omitted and the upper core extension 232 may instead be moved to the unfixed position using one or more downhole devices (not shown). As the upper core extension 232 moves to the unfixed position, the lugs 224 may be correspondingly received into the slots 238 defined in the upper core extension 232. As illustrated, the lugs 224 and the groove 222 may exhibit corresponding angled or ramped surfaces that assist the lugs 224 in radially extending into the slots 238 as the upper core extension 232 moves downward to the unfixed position. In some embodiments, the lugs 224 may be spring loaded and therefore radially biased into the slots 238.

Once the lugs 224 locate and are received into the slots 238, the mandrel 210 is freed and the biasing device 212 is allowed to move from its compressed configuration to its expanded configuration, thereby transferring its stored spring energy to the mandrel 210. As the biasing device 212 expands, the mandrel 210 is forced or otherwise moved downward until the shoulder 216 engages the anvil 228 which stops the axial movement of the mandrel 210. Moving the mandrel 210 downward correspondingly moves the impact tool 226 downward until it extends at least partially out of the housing sleeve 208, as shown in FIG. 2B. By extending at least a short distance out of the housing sleeve 208, the impact tool 226 is able to contact and otherwise deliver an impact force commensurate to the spring force of the biasing device 212 to any object that may be located in its travel path. For example, the impact tool 226 may be configured to deliver the impact force to the downhole obstruction 132, as generally defined above with reference to FIG. 1.

Figure 3:
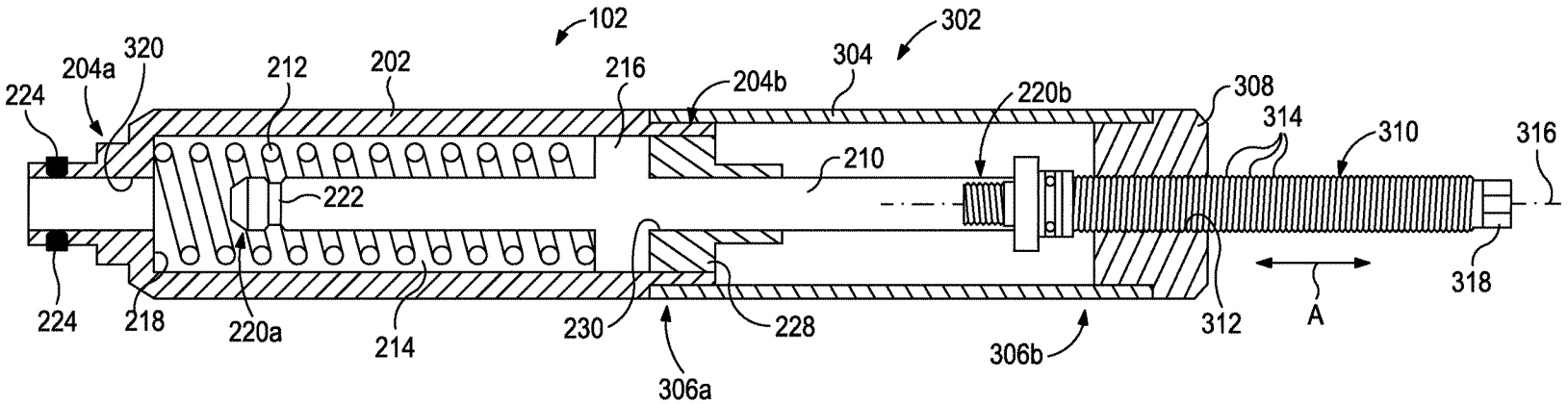
FIG. 3 is a partial cross-sectional view of a portion of the exemplary downhole impact generator of FIG. 2A and a loading tool, according to one or more embodiments.

Once the downhole impact tool 102 is moved from its loaded configuration to its released configuration, the impact tool 102 must be re-set or otherwise re-loaded before being able to be used again. While there may be several ways of re-loading the impact tool 102, as will be appreciated by those skilled in the art, FIG. 3 depicts at least one way to return the impact tool 102 to its loaded configuration. In particular, FIG. 3 illustrates a partial cross-sectional view of a portion of the exemplary downhole impact generator 102 and an exemplary loading tool 302, according to one or more embodiments. The loading tool 302 may be coupled to the impact generator 102 and otherwise used to re-load the impact generator 102 so that it is returned to its loaded configuration.

As illustrated, the loading tool 302 may include a loading sleeve 304 having a first end 306*a* coupled to the downhole end 204*b* of the housing 202. In some embodiments, the first end 306*a* may be threaded to the downhole end 204*b*. In other embodiments, however, the first end 306*a* may be fastened or attached to the downhole end 204*b* using one or more mechanical fasteners such as, but not limited to, bolts, screws, pins, clamps, combinations thereof, and the like.

The loading tool 302 may further include an end cap 308 and an adjusting rod 310 that extends longitudinally through the end cap 308. As illustrated, the end cap 308 may be coupled to a second end 306*b* of the loading sleeve 304. In some embodiments, for example, the end cap 308 may be threaded to the second end 306*b*, but may equally be fastened or otherwise attached to the second end 306*b* using one or more mechanical fasteners such as, but not limited to, bolts, screws, pins, clamps, combinations thereof, and the like.

In some embodiments, the end cap 308 may define a threaded passage 312 configured to receive the adjusting rod 310 therethrough. As illustrated, the adjusting rod 310 may define a series of corresponding threads 314 that extend along at least a portion of the adjusting rod 310, such as in the case of a jack screw or the like. The threads 314 may be configured to mate with the threaded passage 312 such that rotation of the adjusting rod 310 about a central axis 316 may result in the axial translation of the adjusting rod 310 in the directions indicated by the arrow A. In at least one embodiment, a distal end 318 of the adjusting rod 310 may be profiled (e.g., defining a hex head or other tool key design) such that it can be torqued to rotate the adjusting rod 310 in either angular direction (i.e., clockwise or counter-clockwise). By rotating the adjusting rod 310 in a first direction, for example, the adjusting rod 310 may be advanced into the loading sleeve 304 in the uphole direction via engagement with the end cap 308. By rotating the adjusting rod 310 in a second direction opposite the first direction, the adjusting rod 310 may be advanced out of the loading sleeve 304 in the downhole direction via engagement with the end cap 308.

As illustrated, the adjusting rod 310 may be coupled to the mandrel 210 at its distal end 220*b*. Similar to the impact tool 226 (FIGS. 2A and 2B), the adjusting rod 310 may be threaded or otherwise mechanically fastened to the distal end 220*b* of the mandrel 210. Accordingly, as the adjusting rod 310 is torqued about its central axis 316, and thereby translated axially with respect to the end cap 308, the mandrel 210 may also be correspondingly moved in the same axial direction. For example, by torquing the adjusting rod 310 in the first direction, as described above, the mandrel 210 may be forced axially in the uphole direction (i.e., toward the uphole end 204*a* of the housing 202). As the mandrel 210 moves in the uphole direction, the shoulder 216 engages and compresses the biasing device 212 from its expanded configuration back into its compressed configuration.

Continued torquing of the adjusting rod 310 and corresponding axial movement of the mandrel 210 in the uphole direction also serves to extend the proximal end 220*a* of the mandrel 210 back through a channel 320 defined in the uphole end 204 of the housing 202. Once the mandrel 210 is extended within the channel 320, the lugs 224 are able to re-engage the groove 222, as generally depicted in FIG. 2A. Once the lugs 224 are able to be seated within or otherwise engage the groove 222, the upper core extension 232 and the top sub 206 may be replaced at the uphole end 204*a* of the housing 202, thereby securing the lugs 224 within the groove 222 and simultaneously securing the biasing device 212 in its compressed configuration.

In other embodiments, the passage 312 of the end cap 308 may not necessarily be threaded nor does the adjusting rod 310 necessarily have to threadingly engage the end cap 308 to compress the biasing device 212. Rather, the adjusting rod 310 may be forced in the uphole direction with an actuation device (not shown) which provides the required re-load force to compress the biasing device 212. The actuation device may include, but is not limited to, a mechanical actuation device, an electromechanical actuation device, a hydraulic actuation device, combinations thereof, and the like. In such embodiments, the adjusting rod 310 may be characterized as a hydraulic jack, for example.

With the biasing device 212 secured in its compressed configuration, the adjusting rod 310 may be detached from the mandrel 210 and the loading sleeve 304 may be removed from the housing 202. Once the loading sleeve 304 is removed from the housing 202, the housing sleeve 208 (FIGS. 2A-2B) may be re-coupled to the housing 202, as generally described above, and the downhole impact generator 102 may be re-introduced into the wellbore 116 (FIG. 1) to deliver another impact force to a downhole obstruction 132.

Figure 4:
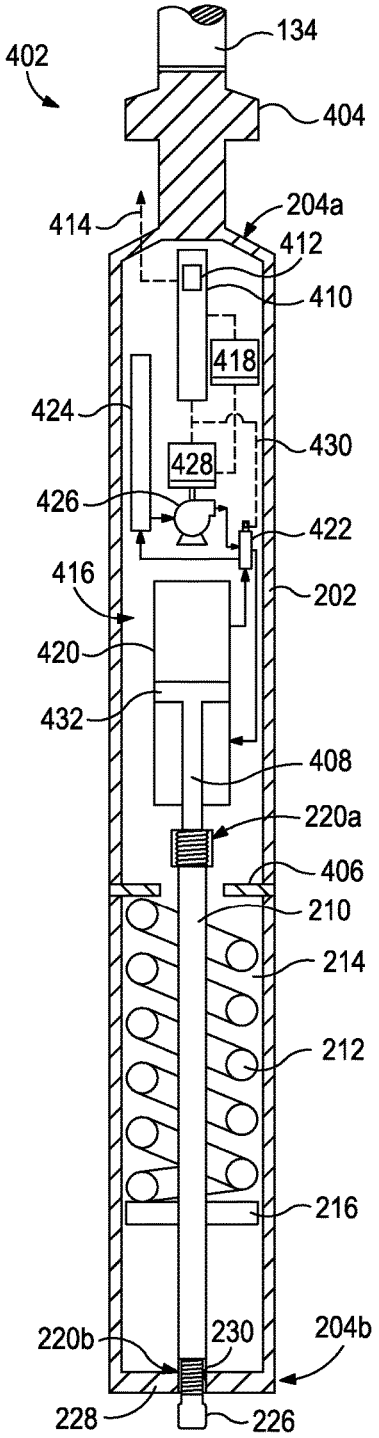
FIG. 4 is a partial cross-sectional view of another exemplary downhole impact generator, according to one or more embodiments.

Referring now to FIG. 4, illustrated is a partial cross-sectional view of another exemplary downhole impact generator 402, according to one or more embodiments. The impact generator 402 may be similar in some respects to the impact generator 102 of FIGS. 2A and 2B and therefore may be best understood with reference thereto, where like numerals will represent like elements not described again in detail. It should be noted that the various illustrated components and structure of the impact generator 402 are not necessarily drawn to scale but are shown for illustrative purposes only and therefore should not be considered limiting to the present disclosure. Rather, those skilled in the art will readily appreciate that various additional components or structural changes may be employed, without departing from the scope of the disclosure.

Similar to the impact generator 102 of FIGS. 2A and 2B, the impact generator 402 may include the housing 202 having an uphole end 204*a* and a downhole end 204*b*. The uphole end 204*a* may define or otherwise provide a fishneck 404 configured to couple the impact generator 402 to either the conveyance 134 (FIG. 1) or another portion of a downhole tool string (not shown), as generally known to those skilled in the art. The mandrel 210 may be movably arranged within the chamber 214 defined in the housing 202 and may define a shoulder 216 that extends radially about the mandrel 210 at an intermediate location along its axial length. At least one biasing device 212 may be arranged within the chamber 214 and otherwise axially arranged between the shoulder 216 and a lip 406 defined in the housing 202. In particular, the distal end of the biasing device 212 may be configured to engage the shoulder 216, while its proximal end may be configured to engage the lip 406.

At its proximal end 220*a*, the mandrel 210 may be coupled or attached to a piston 408. As illustrated, the mandrel 210 may be threadedly engaged with the piston 408, but those skilled in the art will readily recognize that the mandrel 210 may be coupled to the piston 408 in a variety of ways including, but not limited to, mechanical fasteners, clamps, welding, brazing, adhesives, interference fits, combinations thereof, and the like. The anvil 228 may be defined or otherwise provided at or near the downhole end 204*b* of the housing 202. The central channel 230 defined in the anvil 228 may be configured to receive and slidably engage a portion of the mandrel 210 during operation.

The impact generator 402 may include a processor 410 arranged within the body 202. In some embodiments, the processor 410 may be a general purpose microprocessor, a microcontroller, a digital signal processor, an application specific integrated circuit, a printed circuit board, a field programmable gate array, a programmable logic device, a controller, a state machine, a gated logic, discrete hardware components, an artificial neural network, combinations thereof, or any like suitable entity that can perform calculations or other manipulations of data. The processor 410 may include a non-transitory computer-readable medium, such as a memory 412, which may be any physical device used to store programs or data on a temporary or permanent basis for use by the processor 410. The memory 412 may be, for example, random access memory (RAM), flash memory, read only memory (ROM), programmable read only memory (PROM), electrically erasable programmable read only memory (EEPROM), registers, hard disks, removable disks, CD-ROMS, DVDs, any combination thereof, or any other like suitable storage device or medium.

In some embodiments, the processor 410 may be configured for uni- or bi-directional communication with an operator at a surface location (e.g., the oil and gas platform 100 of FIG. 1) via one or more surface communication lines 414. The surface communication line 414 may be any form of wired or wireless technology enabling an operator to communicate with the processor 410 from a remote location. In some embodiments, for example, the surface communication line 414 may be one or more hardwire control lines extending from the surface to the processor 410, and may include, but are not limited to, electrical lines, fiber optic lines, or any type of control line known to those skilled in the art. In other embodiments, the surface communication line 414 may encompass wireless technology including, but not limited to, electromagnetic wireless telecommunication (i.e., radio waves), acoustic telemetry, electromagnetic telemetry, mud pulse telemetry, and the like.

The impact generator 402 may also include an actuation device 416 and one or more power sources 418 configured to power the actuation device 416 and the processor 410. In some embodiments, the power source 418 may be one or more batteries or fuel cells, such as alkaline or lithium batteries. In other embodiments, the power source 418 may be a terminal portion of an electrical line (i.e., e-line) extending from the surface or otherwise any type of device capable of providing power to the processor 410 and/or components of the actuation device 416. In yet other embodiments, the power source 418 may encompass power or energy derived from a downhole power generation unit or assembly, as known to those skilled in the art.

The actuation device 416 may be any mechanical, electromechanical, hydromechanical, hydraulic, or pneumatic device configured to produce mechanical motion that manipulates the axial position of the piston 408, and thereby moves the mandrel 210. In some embodiments, for example, the actuation device 416 may be a motor or the like. In other embodiments, however, the actuation device 416 may be an actuator or a piston and solenoid assembly. In the illustrated embodiment, the actuation device 416 may encompass a hydraulic piston assembly. More particularly, the actuation device 416 may include a hydraulic cylinder 420 fluidly coupled to a solenoid valve 422, a fluid reservoir 424, a pump 426, and a motor 428 used to operate the pump 426.

The motor 428 may be communicably coupled to and otherwise powered by the power source 418. The processor 410 may be communicably coupled to both the motor 428 and the solenoid valve 422 via one or more signal lines 430 such that the processor 410 may be able to send command signals to the motor 428 and the solenoid valve 422 and otherwise regulate their corresponding operation.

When it is desired to move the mandrel 210 and thereby cock the impact tool 226 for delivering a downhole impact force, the processor 410 may communicate with the motor 428 and the solenoid valve 422 in order to provide pressurized fluid from the fluid reservoir 424 to the hydraulic cylinder 420. As illustrated, the piston 408 movably arranged within the hydraulic cylinder 420 may define a head 432 that may sealingly separate upper and lower portions of the hydraulic cylinder 420 such that as pressurized fluid is supplied to the hydraulic cylinder 420 below the head 432, the piston 408 may be moved upward or in an uphole direction within the hydraulic cylinder 420. As the piston 408 moves upward, hydraulic fluid may be simultaneously drawn out of the upper portion of the hydraulic cylinder 420 and deposited back into the fluid reservoir 424 for recycling. During this process, the solenoid valve 422, as operated by the processor 410, may be configured to regulate the fluid flow of the hydraulic fluid in and out of the hydraulic cylinder 420.

As the piston 408 moves upward, the mandrel 210 is correspondingly moved in the same direction and, in turn, serves to compress the biasing device 212 between the shoulder 216 and the lip 406. Compressing the biasing device 212 stores spring energy that may be released upon signaling the solenoid valve 422 to release the hydraulic pressure within the hydraulic cylinder 420. Once the hydraulic pressure is removed, the biasing device 212 may be free to expand and force or otherwise move the mandrel 210 downward until the shoulder 216 engages the anvil 228 which stops the axial movement of the mandrel 210. Moving the mandrel 210 downward correspondingly moves the impact tool 226 downward such that it may be able to contact and otherwise deliver an impact force commensurate to the spring force of the biasing device 212 to any object that may be located in its travel path. For example, the impact tool 226 may be configured to deliver the impact force to the downhole obstruction 132 of FIG. 1.

As will be appreciated, this process of cocking and releasing the mandrel 210 such that the impact tool 126 can provide a downward impact force may be repeated by re-pressurizing the hydraulic cylinder 420 and following the steps provided above once more. In some embodiments, the process may be repeated several times in the event several impacts are desired. In some embodiments, the process may be repeated rapidly, thereby providing repeated impacts in a short time period. Moreover, the impacts may be controlled from the surface through the surface communication line 414 communicating with the processor 410.

Those skilled in the art will readily appreciate the advantages this may provide. For example, traditional detent jars or downhole impact generators are released and/or triggered through wireline or conveyance 134 (FIG. 1) tension, and are therefore relatively slow to re-cock or re-set. The impact generator 402 of FIG. 4, however, may be actuated and triggered using an in situ actuation device 416 and processor 410 combination. As a result, the impact generator 402 may be used somewhat like a rapid fire impact tool, or a jack hammer-type impact generator configured to hit repeated times over a short period of time and at a much faster frequency.

Figure 5:
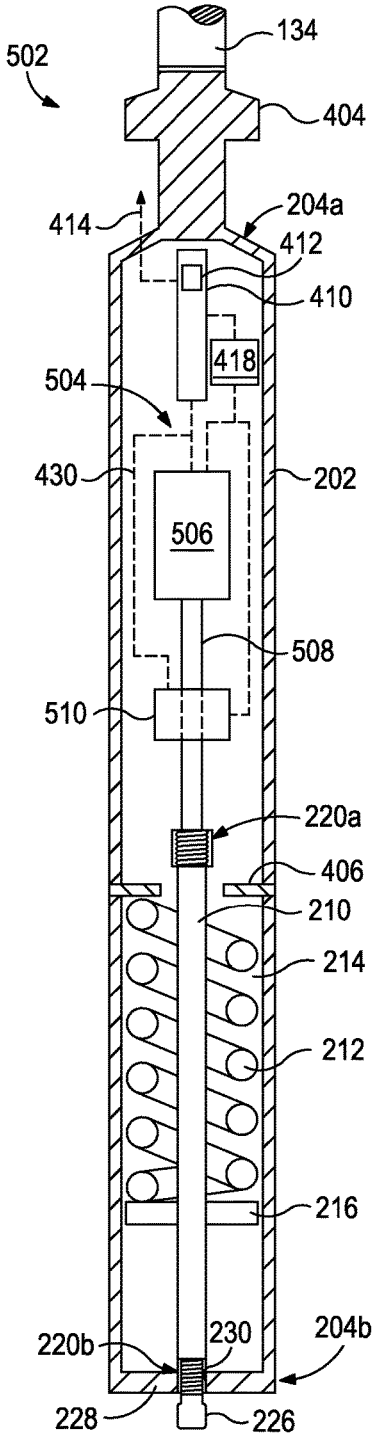
FIG. 5 is a partial cross-sectional view of another exemplary downhole impact generator, according to one or more embodiments.

Referring now to FIG. 5, illustrated is a partial cross-sectional view of another exemplary downhole impact generator 502, according to one or more embodiments. The impact generator 502 may be similar in some respects to the impact generator 402 of FIG. 4 and therefore may be best understood with reference thereto, where like numerals represent like elements not described again. Again, the various illustrated components and structure of the impact generator 502 are not necessarily drawn to scale but are shown for illustrative purposes only and therefore should not be considered limiting to the present disclosure. Those skilled in the art will readily appreciate that various additional components or structural changes may be employed, without departing from the scope of the disclosure.

Similar to the impact generator 402 of FIG. 4, the impact generator 502 may include an actuation device 504 configured to manipulate an axial position of the mandrel 210 in order to cock the impact tool 226 in preparation for delivery of a downhole impact force. Unlike the impact generator 402, however, the actuation device 504 of the impact generator 502 may encompass or otherwise include an electromechanical device. More specifically, the actuation device 504 may include a motor 506, an actuating rod 508 movably coupled to the motor 506, and a clutch 510. As illustrated, the actuation device 504 may be operatively coupled to the mandrel 210 via the actuating rod 508. The motor 506 and the clutch 510 may be communicably coupled to and otherwise powered by the power source 418. The processor 410 may also be communicably coupled to both the motor 506 and the clutch 510 via the signal line 430 such that the processor 410 may be able to send command signals to the motor 506 and the clutch 510 and otherwise regulate their corresponding operation.

When it is desired to move the mandrel 210 and thereby cock the impact tool 226 for delivering an impact force, the processor 410 may communicate with the motor 506 and the clutch 510 in order to retract the actuating rod 508 upward or in an uphole direction. As the actuating rod 508 moves upward (i.e., retracted within the motor 506), the mandrel 210 is correspondingly moved in the same direction and, in turn, serves to compress the biasing device 212 between the shoulder 216 and the lip 406. Compressing the biasing device 212 stores spring energy that may be released upon signaling the clutch 510 to release. Once the clutch 510 releases, the biasing device 212 is free to expand and force or otherwise move the mandrel 210 downward until the shoulder 216 engages the anvil 228 which stops the axial movement of the mandrel 210. Moving the mandrel 210 downward correspondingly moves the impact tool 226 downward such that it may be able to contact and otherwise deliver an impact force commensurate to the spring force of the biasing device 212 to any object (e.g., the downhole obstruction 132 of FIG. 1) that may be located in its travel path.

Similar to the impact generator 402 of FIG. 4, the process of cocking and releasing the mandrel 210 of the impact generator 502 such that the impact tool 126 can provide a downward impact force may be repeatable by repeating the steps provided above. Moreover, the impacts may be controlled from the surface through communication with the processor 410 in the impact generator 502 via the surface communication line 414.

Figure 6:
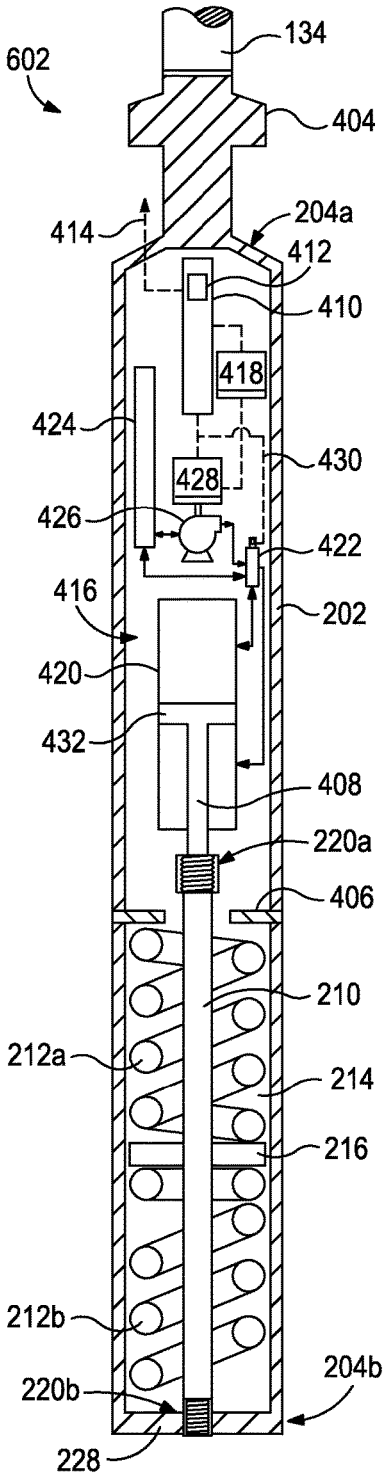
FIG. 6 is a partial cross-sectional view of an exemplary bi-directional downhole impact generator, according to one or more embodiments.
Figure 7:
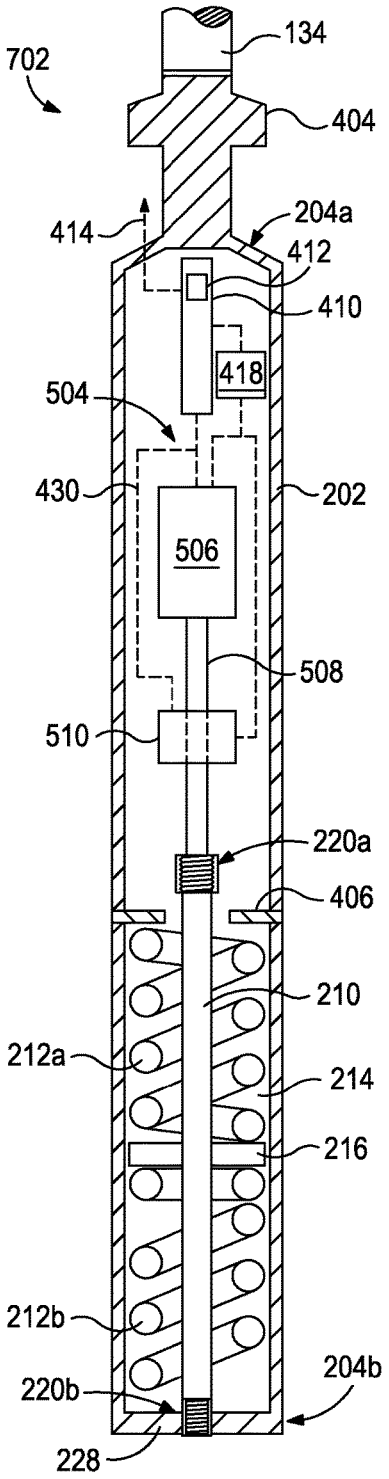
FIG. 7 is a partial cross-sectional view of another exemplary bi-directional downhole impact generator, according to one or more embodiments.

Referring now to FIGS. 6 and 7, with continued reference to FIGS. 4 and 5, illustrated are partial cross-sectional views of additional exemplary downhole impact generators 602 and 702, respectively, according to one or more embodiments. The impact generators 602 and 702 may be similar in some respects to the impact generators 402 and 502, respectively, of FIGS. 4 and 5, and therefore may be best understood with reference thereto, where like numerals represent like elements not described again. Again, the various illustrated components and structure of the impact generators 602 and 702 are not drawn to scale but are shown for illustrative purposes only. Those skilled in the art will readily appreciate that various additional components or structural changes may be employed, without departing from the scope of the disclosure.

Unlike the impact generators 402 and 502 of FIGS. 4 and 5, the impact generators 602 and 702 of FIGS. 6 and 7, respectively, may be characterized as bi-directional detent jars or impact generators. In other words, whereas the impact generators 402 and 502 of FIGS. 4 and 5 are configured to deliver impact forces in only one direction, the impact generators 602, 702 may be configured to deliver impact forces in both the uphole and downhole directions, as dictated by the commands provided by the processor 410.

To accomplish bi-directional impact force capability, the chamber 214 in each impact generator 602, 702 may include at least two biasing devices 212*a* and 212*b*. Similar to the biasing device 212 of FIGS. 2-5, the biasing devices 212*a,b* may be compression springs, coil springs, a series of Belleville washers, or any other device configured to store spring force upon being axially manipulated with the mandrel 210. In some embodiments, for example, at least one of the biasing devices 212*a,b* may be a hydraulic or pneumatic accumulator, or the like, configured to store high pressure fluids that act as a spring force upon being properly released.

The first biasing device 212*a* may be arranged within the chamber 214 between the shoulder 216 and the lip 406 such that the distal end of the first biasing device 212*a* may engage the shoulder 216, while its proximal end engages the lip 406. The second biasing device 212*b* may be arranged within the chamber 214 between the shoulder and the anvil 228 such that the proximal end of the biasing device 212 engages the shoulder 216, while its distal end engages the anvil 228. Depending on which direction an impact force is desired, the biasing devices 212*a,b* may be configured to work in conjunction with the mandrel 210.

Providing a downward impact force using the impact tool 226 (FIGS. 4 and 5) may be accomplished as generally described above with reference to FIGS. 4 and 5, where the first biasing device 212*a* serves generally as the biasing device 212 described therein. Providing an upward or uphole impact force, however, may require that the actuation devices 416, 504 of the impact generators 602, 702, respectively, reverse their cocking and releasing movements and utilize the spring force provided by the second biasing device 212*b*.

For example, referring to FIG. 6, when it is desired to provide an uphole impact force with the impact generator 602, the distal end 220*b* of the mandrel 210 may be operatively attached to a downhole obstruction 132 (FIG. 1) using, for example, a latch tool (not shown) or the like. The processor 410 may communicate with the motor 428 and the solenoid valve 422 in order to provide pressurized fluid from the fluid reservoir 424 to the hydraulic cylinder 420 above the head 432 of the piston 408. As pressurized fluid is supplied to the hydraulic cylinder 420 above the head 432, the piston 408 may be forced or moved downward within the hydraulic cylinder 420. As the piston 408 moves downward, hydraulic fluid may be simultaneously drawn out of the lower portion of the hydraulic cylinder 420 and deposited back into the fluid reservoir 424 for recycling. During this process, the solenoid valve 422, as operated by the processor 410, may be configured to regulate the fluid flow of the hydraulic fluid.

As the piston 408 moves downward, the mandrel 210 is correspondingly moved in the same direction and, in turn, serves to compress the second biasing device 212*b* between the shoulder 216 and the anvil 228. Compressing the second biasing device 212*b* stores spring energy that may be released upon signaling the solenoid valve 422 to release the hydraulic pressure within the hydraulic cylinder 420. Once the hydraulic pressure is removed, the second biasing device 212*b* may be free to expand and force or otherwise move the mandrel 210 upward at a high velocity, and simultaneously transferring the attendant impact force to any objects coupled to the mandrel 210 at its distal end 220*b*.

Similarly, with reference to FIG. 7, when it is desired to provide an uphole impact force with the impact generator 702, the distal end 220*b* of the mandrel 210 may be operatively attached to a downhole obstruction 132 (FIG. 1). The processor 410 may communicate with the motor 506 and the clutch 510 in order to extend the actuating rod 508 downward (i.e., downhole) and thereby correspondingly moving the mandrel 210 in the same direction. Moving the mandrel 210 in the downhole direction, in turn, serves to compress the second biasing device 212*b* between the shoulder 216 and the anvil 228. Compressing the second biasing device 212*b* stores its spring energy that may be released upon signaling the clutch 510 to release (i.e., with the processor 410), thereby freeing the second biasing device 212*b* to expand and force or otherwise move the mandrel 210 upward at a high velocity, and simultaneously transferring the attendant impact force to any objects coupled to the mandrel 210 at its distal end 220*b*.

As will be appreciated, the process of cocking and releasing the mandrels 210 of both impact generators 602, 702 may be repeated in either direction (i.e., uphole or downhole) such that impact forces may be delivered in both directions multiple times while the impact generators 602, 702 are arranged downhole. Moreover, the bi-directional impacts may be controlled from the surface through the surface communication line 414 communicating with the processors 410.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A downhole impact generator, comprising:

a housing having an uphole end and a downhole end and defining a chamber therein between the uphole and downhole ends;

a mandrel movably arranged at least partially within the chamber between an engaged configuration and a disengaged configuration;

a top sub coupled to the housing at the uphole end and having an upper core extension arranged at least partially therein, the upper core extension being configured to move between a fixed position, where the mandrel is maintained in the engaged configuration, and an unfixed position, where the mandrel is able to move to the disengaged configuration; and an impact tool coupled to a distal end of the mandrel to deliver an impact force to a downhole obstruction, wherein the impact tool only contacts the downhole obstruction upon moving the mandrel to the disengaged configuration to deliver the impact force to the downhole obstruction.

2. The downhole impact generator of claim 1, further comprising a biasing device axially arranged within the chamber between the housing and a shoulder defined on the mandrel, the biasing device being configured to move between a compressed configuration, where the mandrel is in the engaged configuration, and an expanded configuration, where the biasing device moves the mandrel to the disengaged configuration.

3. The downhole impact generator of claim 2, further comprising an anvil arranged within the housing at or near the downhole end, the anvil being configured to engage and stop the shoulder of the mandrel as the biasing device moves the mandrel to its disengaged configuration.

4. The downhole impact generator of claim 1, further comprising one or more lugs configured to be received within an annular groove defined on the mandrel in order to maintain the mandrel in the engaged configuration.

5. The downhole impact generator of claim 4, further comprising one or more slots defined in the upper core extension and configured to receive the one or more lugs when the upper core extension moves to the unfixed position.

6. The downhole impact generator of claim 1, further comprising one or more shearable devices configured to secure the upper core extension in the fixed position.

7. The downhole impact generator of claim 1, further comprising a loading tool configured to move the mandrel back into the engaged configuration, the loading tool comprising:

a loading sleeve having a first end coupled to the downhole end of the housing;

an end cap coupled to a second end of the loading sleeve and defining a passage therethrough; and an adjusting rod extending longitudinally through the passage of the end cap and, following removal of the impact tool, being engageable with the distal end of the mandrel such that moving the adjusting rod in a first direction moves the mandrel axially within the housing toward its engaged configuration.

8. The downhole impact generator of claim 7, wherein the passage is threaded and the adjusting rod defines a series of threads that are engageable with the passage such that rotation of the adjusting rod about a central axis results in axial translation of the adjusting rod in the first direction with respect to the end cap.

9. The downhole impact generator of claim 7, wherein the adjusting rod is moved in the first direction with an actuation device.

10. A method of delivering an impact force to a downhole obstruction within a wellbore, comprising:

conveying an impact generator to the downhole obstruction, the impact generator comprising a housing, a mandrel movably arranged at least partially within a chamber defined in the housing, and a top sub coupled to an uphole end of the housing and having an upper core extension arranged at least partially within the top sub;

moving the upper core extension from a fixed position, where the mandrel is maintained in an engaged configuration within the housing, to an unfixed position, where the mandrel is able to move to a disengaged configuration;

moving the mandrel to the disengaged configuration with a biasing device axially arranged within the chamber and thereby driving an impacting tool coupled to a distal end of the mandrel toward the downhole obstruction; and impacting the downhole obstruction with the impact tool upon moving the mandrel to the disengaged configuration, wherein the impact tool only contacts the downhole obstruction upon moving the mandrel to the disengaged configuration to deliver the impact force to the downhole obstruction.

11. The method of claim 10, further comprising maintaining the mandrel in the engaged configuration using one or more lugs received within an annular groove defined on the mandrel.

12. The method of claim 11, wherein moving the upper core extension from the fixed position to the unfixed position comprises:

receiving the one or more lugs within one or more slots defined in the upper core extension; and freeing the mandrel from engagement with the one or more lugs such that the biasing device is able to move the mandrel to the disengaged configuration.

13. The method of claim 11, wherein the upper core extension is secured in the fixed position with one or more shearable devices, and moving the upper core extension from the fixed position to the unfixed position comprises:

receiving an axial impact force with the upper core extension;

breaking the one or more shearable devices and thereby allowing the upper core extension to move to the unfixed position;

receiving the one or more lugs within one or more slots defined in the upper core extension; and freeing mandrel from engagement with the one or more lugs such that the biasing device is able to move the mandrel to the disengaged configuration.

14. The method of claim 10, wherein moving the mandrel to the disengaged configuration with the biasing device further comprises allowing the biasing device to move from a compressed configuration to an expanded configuration.

15. The method of claim 10, wherein the mandrel defines a shoulder that extends radially therefrom, the method further comprising engaging the shoulder of the mandrel with an anvil arranged within the housing at or near the downhole end as the biasing device moves the mandrel to its disengaged configuration.

16. The method of claim 10, wherein the downhole obstruction is at least one of debris and a well tool disposed in the wellbore and wherein impacting the downhole obstruction with the impact tool further comprises breaking up the debris and/or the well tool such that communication therethrough within the wellbore is facilitated.

17. The method of claim 10, wherein the downhole obstruction is a well tool disposed in the wellbore and impacting the downhole obstruction with the impact tool further comprises activating the well tool.

18. The method of claim 10, further comprising:

removing the impact tool from the distal end of the mandrel;

coupling a loading sleeve to the downhole end of the housing, the loading sleeve having an end cap secured therein and defining a threaded passage therethrough;

coupling an adjusting rod to the distal end of the mandrel, the adjusting rod extending longitudinally through the threaded passage of the end cap and defining a series of threads that are engageable with the threaded passage;

rotating the adjusting rod about a central axis and thereby axially translating the adjusting rod and the mandrel in an uphole direction, whereby the mandrel is urged back toward its engaged configuration.

19. The method of claim 18, further comprising receiving one or more lugs within an annular groove defined on the mandrel and thereby securing the mandrel in the engaged configuration.

* * * * *